US005573081A

United States Patent [19]

Bartnicki et al.

[11] Patent Number: 5,573,081

[45] **Date of Patent: *Nov. 12, 1996**

[54] LADDER TOP WITH BAIL RECESS

[75] Inventors: Frederick J. Bartnicki; Lauren S. Sherbondy, both of Greenville; Donald M. Werner, Hermitage; Robert Beggs, Fredonia; Dale R. King, Greenville; Harold L. Bernard, Transfer, all of Pa.

[73] Assignee: Werner Co., Greenville, Pa.

[ * ] Notice: The term of this patent shall not extend beyond the expiration date of Pat. No. 5,259,480.

[21] Appl. No.: 267,857

[22] Filed: Jun. 29, 1994

Related U.S. Application Data

[63] Continuation of Ser. No. 7,908, Jan. 22, 1993, abandoned, which is a continuation-in-part of Ser. No. 906,587, Jun. 30, 1992, Pat. No. 5,259,480, which is a continuation of Ser. No. 471,129, Jan. 26, 1990, Pat. No. Des. 340,773, which is a continuation-in-part of Ser. No. 100,432, Sep. 24, 1987, Pat. No. Des. 310,884.

[51] Int. Cl.[6] ..... E06C 1/00

[52] U.S. Cl. ..... 182/129; 182/46

[58] Field of Search ..... 182/129, 46; 248/225.1, 248/211, 236, 210; 211/88

[56] References Cited

U.S. PATENT DOCUMENTS

| | | | |
|---|---|---|---|
| 1,379,419 | 5/1921 | Reeves | 182/129 X |
| 2,234,944 | 3/1941 | Rich et al. | 182/129 X |
| 3,010,535 | 11/1961 | Depiano | 182/129 |
| 3,857,460 | 12/1974 | Nini | 182/129 X |
| 3,908,831 | 9/1975 | Brendgord | 211/88 |
| 4,023,647 | 5/1977 | Confer | 182/46 X |
| 4,531,645 | 7/1985 | Tisbo | 211/70.6 |
| 4,899,970 | 2/1990 | Brezina | 182/129 X |
| 4,979,590 | 12/1990 | Bailey | 182/129 |

FOREIGN PATENT DOCUMENTS

| | | | |
|---|---|---|---|
| 664333 | 8/1938 | Germany | 182/129 |

OTHER PUBLICATIONS 4 photographs of a ladder top.

*Primary Examiner*—Alvin C. Chin-Shue
*Attorney, Agent, or Firm*—Ansel M. Schwartz

[57] ABSTRACT

A molded rectangular top component of a stepladder is disclosed which incorporates an improved method of securely supporting a bucket or paint can at the top of the ladder. A recess in a second wall of the laddertop corresponds to and accommodates the arcuate shape of the bail of a bucket, and a hook is attached at the lower portion of the recess, which has the beneficial effect of moving the weight closer to the center of the ladder than on a protruding hook. The ladder top includes at least one slot in a first wall which extends from the ladder top through which accessories can be attached. The first wall opposes the second wall.

12 Claims, 4 Drawing Sheets

LADDER TOP WITH BAIL RECESS

This is a continuation of U.S. patent application Ser. No. 08/007,908, filed Jan. 22, 1993, abandoned, which is a continuation-in-part of U.S. patent application Ser. No. 07/906,587, filed Jun. 30, 1992, now U.S. Pat. No. 5,259,480, issued 11/09/93, which is a continuation of U.S. patent application Ser. No. 07/471,129, filed Jan. 26, 1990, now U.S. Pat. No. D340,773, issued 10/26/93, which is a continuation-in-part of U.S. patent application Ser. No. 07/100,432, filed Sep. 24, 1987, now U.S. Pat. No. D310,884, issued 9/25/90.

BACKGROUND OF THE INVENTION

The invention described herein relates to ladder constructions and manufacture thereof, and accessory features in climbing equipment such as stepladders for use while performing work on the ladder. Specifically, in the construction of a stepladder top, an accessory feature is included that enables stable and safe support of a paint bucket or pail containing a fluid that is to be used by a workman at an elevated position.

Safety, convenience and efficiency have been persistent concerns in the working environment involving ladders and elevated working positions in both outdoor and indoor environments, and there has been a continuous design effort for many decades to bring improvements to the design of climbing equipment that will enhance safe and effective functioning. The safe handling of fluids such as cleaning solutions and paint is one of these concerns, and there have been a number of improved products that have incrementally addressed the problem of carrying and supporting these fluids in their typical containers while working on ladders. As these fluids are typically carried or provided in buckets or cans that include bail-type carrying handles, design of retention means may address improved safety by improving the security of suspending the bucket by its bail.

Paint can and bucket support means have been included in ladder designs as a separate shelf below the top, as various hooks and protrusions from the ladder stiles and rungs and from the ladder top. All of these have encountered drawbacks in operation. Paint shelves on which the bucket merely rests, either with or without a tray or depression to fit the can, are inherently unstable, and the can may be upset with unfortunate consequences by inadvertent contact with the can or by instability of the ladder itself. Various hooks or protrusions provided on the ladders are limited by interference with the vertical components of the ladder which offset of the center of the bail from the center of the can in any position other than being suspended with no obstructions below the hook. The only accessible spot in a stepladder for unobstructed suspension of the bucket is from the top component of the stepladder, and the more centered the suspension point is, the more stable the suspension of the bucket will be. A competing consideration, however, is that the suspension point or hook is more convenient to the user if it is placed at the outer edge of the ladder top, to position it for access as it is placed near the wall or surface to be worked. This problem is also made more difficult by the arcuate shape of the bail itself which can interfere with placement against a fiat side surface.

DISCLOSURE OF THE INVENTION

The within invention is an improved means of conveniently and safely supporting the bucket by its bail with a hook means incorporated into the ladder top component of an A-design stepladder. A cast or stamped form of ladder top is designed for secure attachment to typical 4 leg stepladder construction by swiveling means such as rivets or bolts to the top of the legs. While this type of ladder top design has been made before, including the design of applicant in a previous application now pending as Ser. No. 07/471129, the present improvements specifically address the problem of paint bucket retention safety in the novel way described below. In the side of the generally rectangular ladder top nearest the working surface (the front) a hook is cast into a typically plastic form for support of the bucket by its bail. But, as discussed above, the hook should not protrude outward because the weight of the bucket would produce an unstable moment force removed from the center of the top component. It also cannot be at the center point of the top, since access to the bucket would be made difficult by the worker having to reach under the top to reach the material contained in the bucket. A compromise position for the hook is to put the hook in line with the plane of the front of the laddertop and pointing outward, but, once again, the arcuate shape of the bail will interfere with readily hanging the bail on the hook. This is an important safety consideration, since the worker has only one hand to support and maneuver the paint bucket, as his other hand will be in use to retain himself on the ladder. Therefore the laddertop design depicted and claimed below accommodates safe and ready insertion of the bucket onto the hook by incorporating a specially designed clearance for the arcuate bail. The cast manufacturing method of the ladder top enabled by the use of plastic materials makes such specially designed clearance depressions possible, where traditional ladder constructions of wood and metal materials would make the manufacture of complex designs more difficult and costly.

Thus, the objective of the within invention is to provide a means for secure retention of a paint bucket at the top of a stepladder in a safe, efficient and practical manner not found in previous ladder construction designs.

DESCRIPTION OF THE PREFERRED EMBODIMENT

Figure 1:
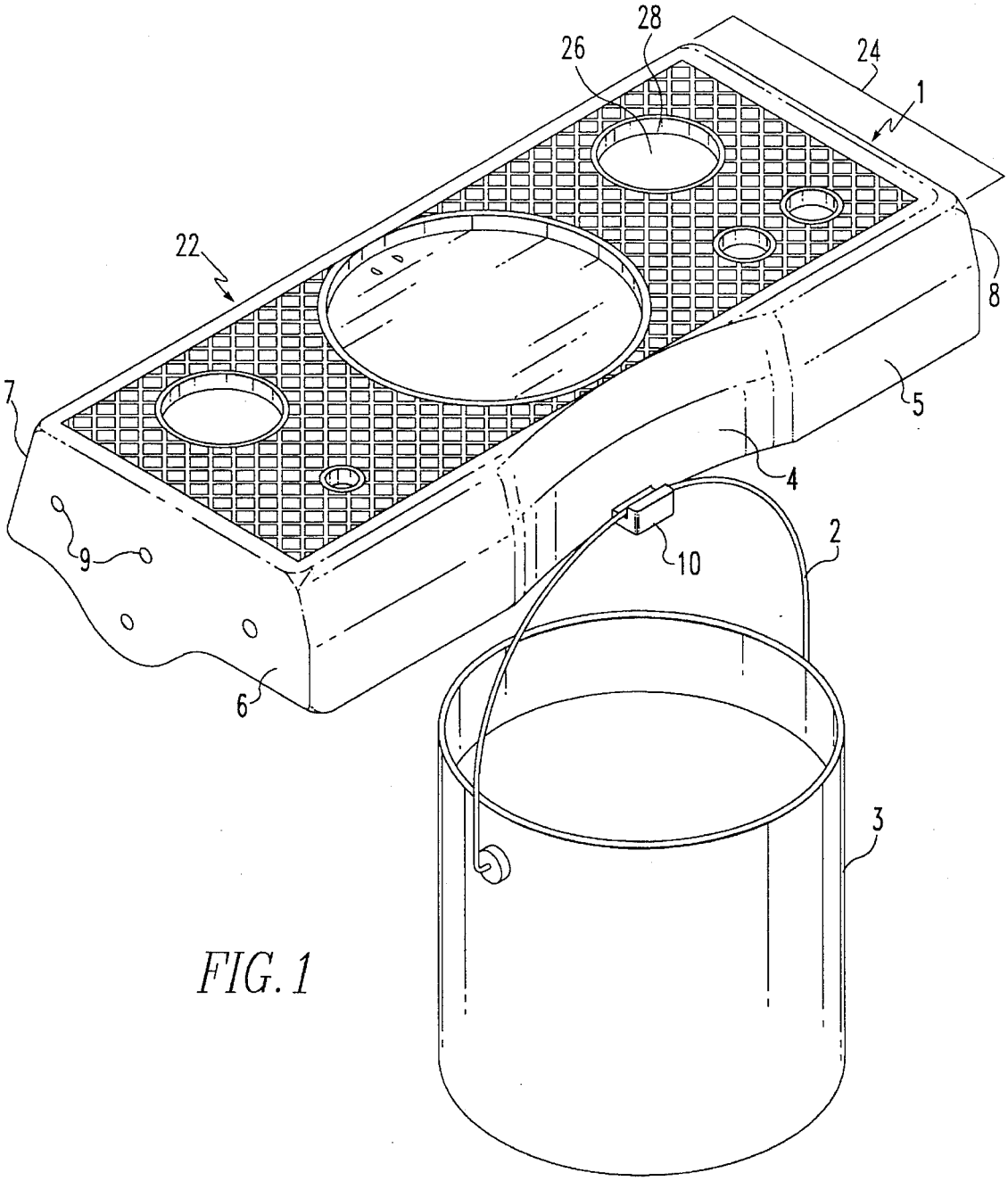
FIG. 1 is a perspective view of the ladder top design, showing the paint bucket bail recess and hook and a typical paint bucket with bail being attached to the hook.

Referring to FIG. 1 of the drawings, it can clearly be seen that the ladder top component 1 (which is attached to a number of ladder legs or stiles, not shown, and typically four in number) is designed to accommodate safe and convenient insertion of the bail-style handle 2, of paint bucket 3. The arcuate shape of the bail itself is mirrored by the arcuate depression 4 in the front side 5 of the ladder top. The top is formed by molding or casting in plastic or similar forming material with sufficient strength to withstand weights and forces imposed on a stepladder designed to support at least the weight of a workman and his tools, materials and workpieces. The molding or casting method of manufacture has the additional advantage, which is significant in this invention as is apparent below, of forming a piece of unitary structure including its reinforcements and appendages. Further, the integral molded construction of the top surface and the downward extending sides or walls 5, 6, 7, and 8 forms a rigidified structure that is important in itself in safe and durable ladder design. The within invention is an improvement in the form of an additional feature, and a primary objective to the design of this feature is that it should not weaken or diminish the function, safety or durability of the basic design shape of the laddertop in any way.

The laddertop is formed in familiar rectangular shape found on most folding stepladders, and includes appropriate reinforced pre-formed attachment points such as grommets or holes 9 for rotatable attachment of the ladder rails by suitable bolts or rivets (not shown). Other features shown in FIGS. 1, 2 and 3 such as the hatched surface, decorative designs, top tool and parts tray, and reinforcing interior ribs are either typical previous features of laddertop construction or not relevant to the within invention. Finally, in each of these views, the retaining hook 10, on which the bucket is supported, extends from the lower edge of the front panel at the innermost extending point of the arcuate recess; hook leg 10*a* in turn supports hook extension 10*b* at a right angle or sufficient angle to securely retain the overhanging wire bail.

Previous attempts to support a typical paint bucket by its bail from a ladder have included merely attaching a separate protruding hook to the ladder top or siderails, or providing a shelf or other folding attachable means of support. These have been unsatisfactory for at least two reasons; first protruding elements are undesirable since they may contact work surfaces or break off in accidental collisions; second, they may make the entire ladder more unstable as weight is added farther away front the center of gravity of the entire ladder assembly and supported weight. One solution is to put a hook support under the ladder top, but in attempting to use a device in such a concealed position, the workman will lose sight of the bucket as it is moved under the top, making the operation precarious. The within invention captures the advantages of placing the retaining hook closer to the center of gravity of the ladder, at the same approximate position as an under-mounted hook, but without losing line of sight, by providing an access depression in the side of the laddertop on which the hook is mounted. Although the cutout or depressed portion of that side could be formed in any shape, the preferred shape conforms to the arcuate shape of the bucket bail itself, both to accommodate the bail as it is inserted onto the hook without obstruction, and to enable insertion while moving only a minimum of the material forming the reinforced top structure front the plane of that side. A curved form is not only convenient and advisable front a structural consideration, but enables the bail to move in its natural arc as it is hooked on and left to swing, rather than a fiat or other form of recess that would obstruct the arc of the bail.

While the arcuate depression as illustrated in the preferred embodiment is a portion of a cylinder, the depression could also be a portion of a sphere which would be wider at the bottom of the depression than at its top, or other modified arcuate shape. Similarly the shape of the depression need not be a precise circular section, but need only essentially accommodate the shape of the bucket bail at all angles of insertion that would be expected.

Figure 2:
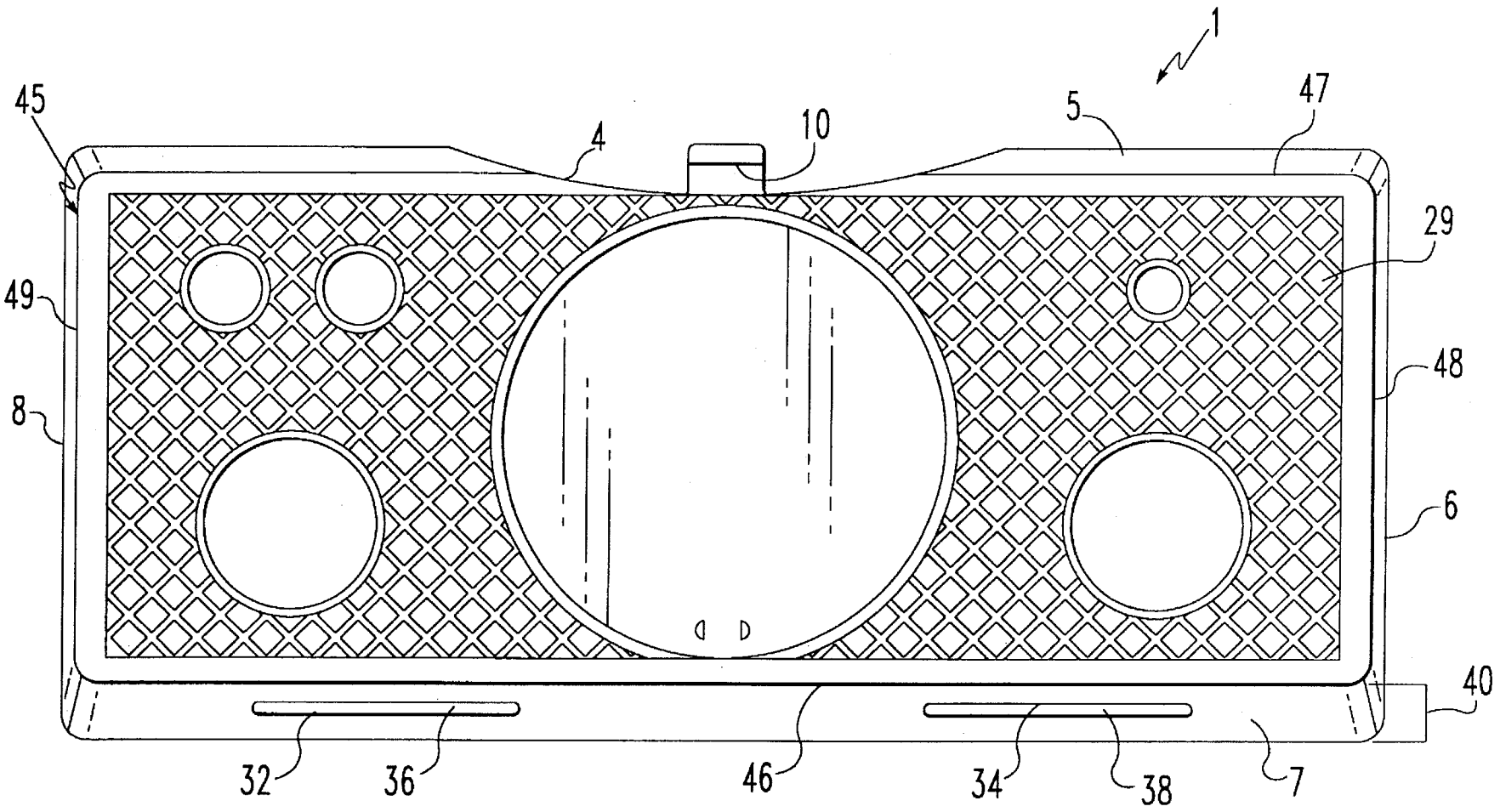
FIG. 2 is a plan view of the ladder top component from the top.

FIG. 2 of the drawings shows more clearly in top plan view that the depression in the plane of the front side in arcuate shape constitutes only a minimum disturbance in the structural integrity of the molded piece, yet fully accommodates insertion of the bucket bail shape within and past the side plane. It may also here be seen that the integral hook 10 extends forward of the main body of the unitary cast laddertop for receiving the bail of the suspended bucket, but extends no farther than the plane of the forward edge. Limiting the protrusion of the hook in this manner while enabling accessibility for its purpose prevents the obstruction or hazard that a further protruding hook would present; without the recessed configuration as shown, such protrusion would be necessary. It may also be seen in this view that the recessed hook configuration is fully visible to the workman from a viewing position above the laddertop; other bucket hooks on ladders have been placed below the top which presents problems with safe and ready placement of the bail support on the hook.

Figure 3:
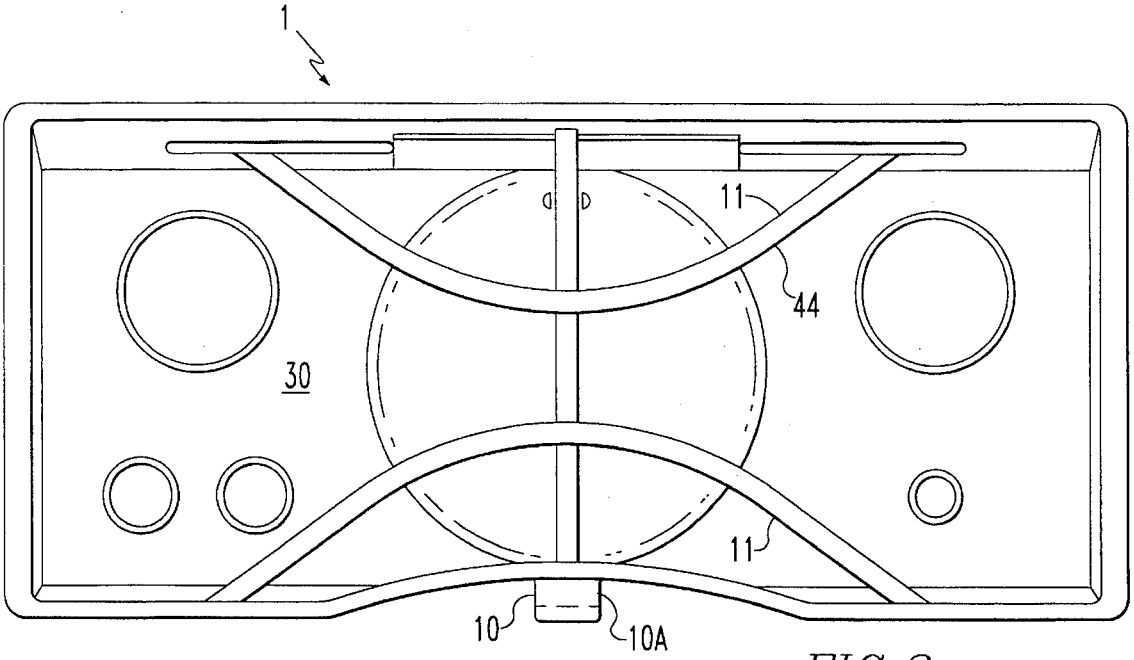
FIG. 3 is a plan view of the ladder top component from the bottom.

FIG. 3 shows in bottom plan view the reinforcing ribs 11 and the minimal disruption of the pattern of ribs by the arcuate recess in the front panel. The integral meeting and connection of the hook lower leg 10a and the edge of the depression is well under the covering perimeter of the overall shape of the top plane.

Figure 4:
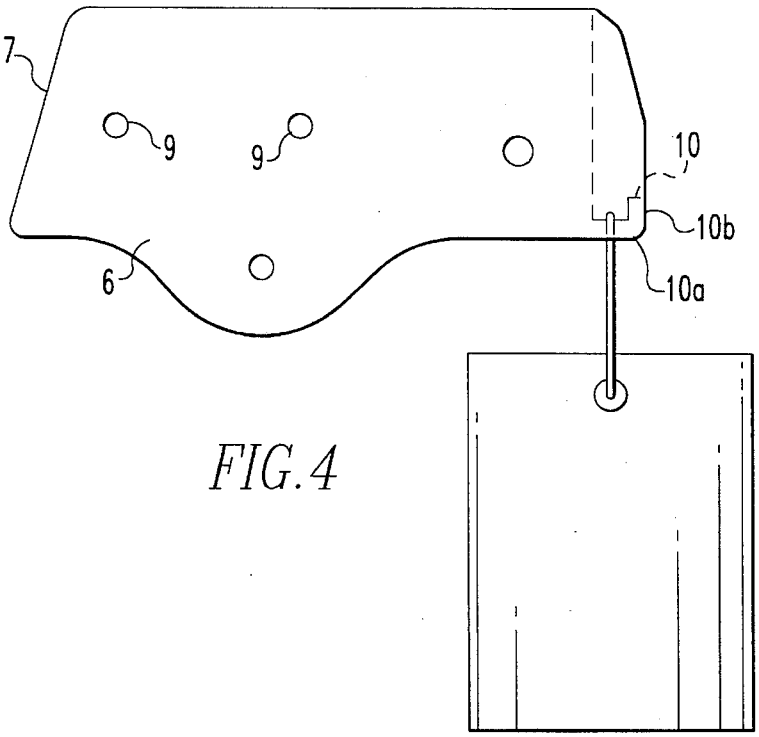
FIG. 4 is a side view of the ladder top, showing the bail of a bucket on the retaining hook in hidden view.

FIG. 4 shows in side view that the hook 10 (hidden view) supports the bucket weight under and within the top perimeter, and closer to the center of gravity than if the hook were further protruding. It may also be seen in this view that a workman positioned over the ladder top can still maintain a continuous line of sight as he maneuvers the bail of the paint bucket with one hand onto the recessed hook.

Figure 5:
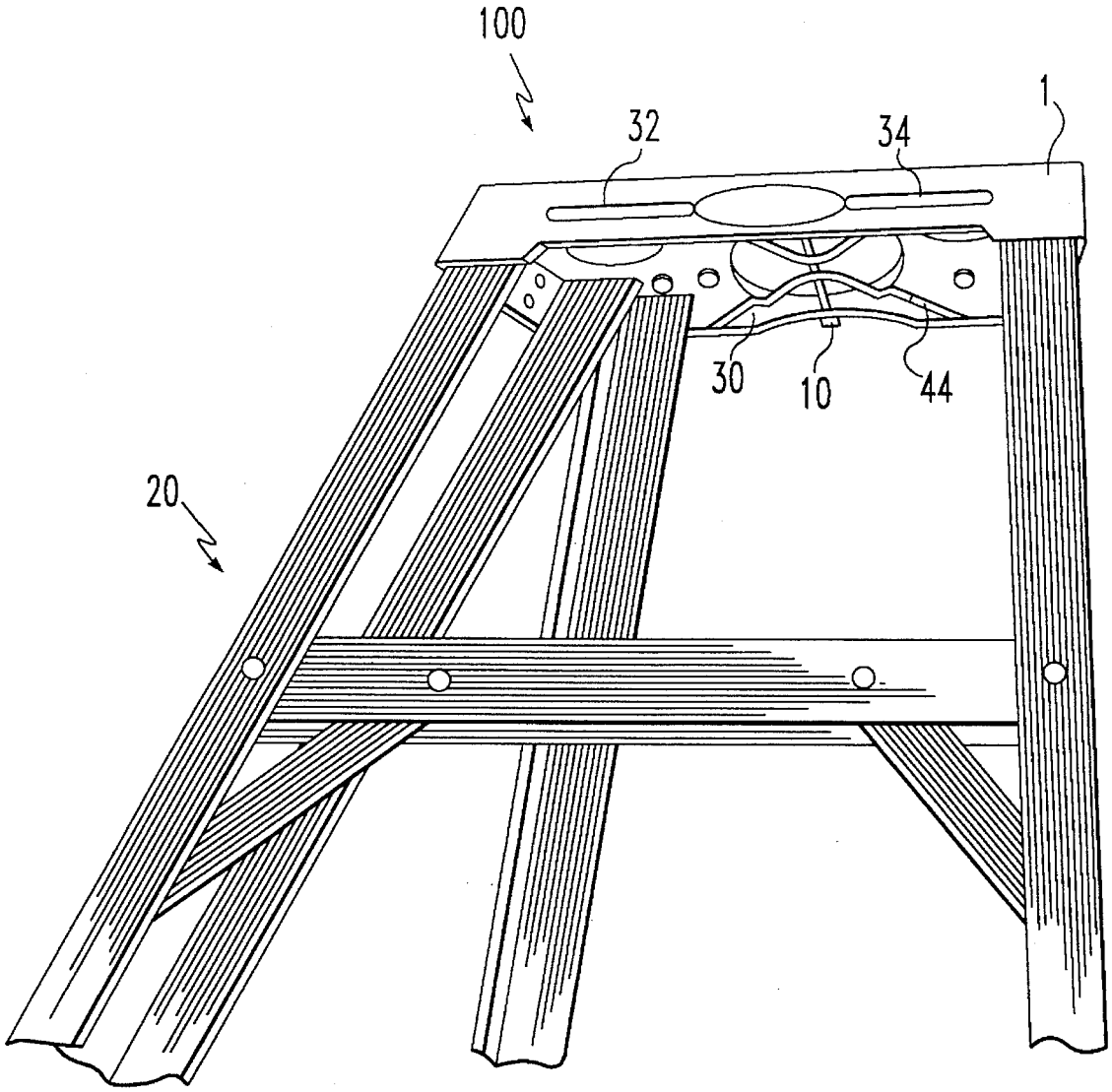
FIG. 5 is a perspective view of a ladder system of the present invention.

The present invention pertains to a ladder system 100 as shown in FIG. 5. The ladder system 100 comprises at least one set of legs 20. There is a ladder top 1 comprising a top panel 22 which defines a first plane 24, as shown in FIG. 1. The top panel 22 has a hole 26 for holding a tool. The hole 26 has a hole face 28 oriented essentially parallel with the first plane 24. The top panel 22 has a top side 29 and an underside 30, and a plurality of side walls extending in an integral fashion essentially perpendicular from the top panel 22. The at least one set of legs 20 is attached to the side walls of the ladder top 1. The ladder top 1 also comprises a first slot 32 and a second slot 34 in spaced relation with the first slot 32 through which accessories can be attached. The first slot 32 has a first slot face 36 and the second slot 32 has a second slot face 38. The first and second slot face are each oriented essentially perpendicular with the first plane 24. The first and second slot face define a second plane 40 which is also perpendicular with the first plane 24. The top 1 also has buttressing 44 extending from the underside 30 and in contact with the plurality of side walls. The ladder top 1 is preferably made of plastic.

The plurality of side walls preferably includes a first side wall 7 and an opposing second side wall 5. The first and second side walls preferably extend in an integral fashion from the underside 30 of the top panel 22. Preferably, the first and second slots are disposed in the first side wall 7 and below the top panel 22.

The top panel 22 preferably has a perimeter 45. The perimeter 45 has at least a first edge 46, a second edge 47, a third edge 48 and a fourth edge 49. The topside 29 and underside 30 of the top panel 22 are preferably disposed between the first, second, third and fourth edges. The plurality of side walls preferably comprise the first side wall 7 extending in an integral fashion from the underside 30 along the first edge 46; the opposing second side wall 5 extending in an integral fashion from the underside 30 along the second edge 47, a third side wall 6 extending in an integral fashion from the underside 30 along the third edge 48 and in juxtaposition with the first and second side walls, and a fourth side wall 8 opposing the third side wall 6 and extending in an integral fashion from the underside 30 along the fourth edge 49 and in juxtaposition with the first and second side walls, as shown in FIG. 2. The third and fourth side walls have holes 9 through which the at least one set of legs 20 is attached to the ladder top 1.

Having described the preferred embodiment, it will be appreciated by the reader that other constructions may be conceived that embody the concepts and features described and come within the spirit of the appended claims.

I claim:

1. A top for a ladder comprising:

a top panel having a perimeter, said perimeter having at least a first edge, a second edge, a third edge and a fourth edge, said top panel having a topside and an underside disposed between the first, second, third and fourth edges; and a first side wall extending in an integral fashion from the underside along the first edge, the first side wall having a pair of elongate slots through which accessories of the ladder can be attached, an opposing second side wall extending in an integral fashion from the underside along the second edge, said second side wall having an arcuate depression with an outer surface and a hook extending from said outer surface, a third side wall extending in an integral fashion from the underside along the third edge and in juxtaposition with the first and second side walls, and a fourth side wall opposing said third side wall and extending in an integral fashion from the underside along the fourth edge and in juxtaposition with the first and second side walls, said ladder adapted to be connected to the ladder top through said third and fourth side walls.

2. A top as described in claim 1 wherein the second wall has a bottom edge and the hook extends from the bottom edge.

3. A top as described in claim 2 wherein the arcuate depression has a center and the hook extends from the bottom edge at the center of the arcuate depression.

4. A top as described in claim 3 wherein the arcuate depression has a radius approximating a radius of a bail of a one gallon paint can.

5. A top as described in claim 4 wherein the second side wall defines an envelope and the hook extends from the outer surface but stays within the envelope.

6. The ladder top of claim 5 wherein said hook further comprises an outwardly extending portion normal to a plane defined by said second side wall, said outwardly extending portion having a first end and a second end, said first end of said outwardly extending portion attached to the lower edge of the second side wall, and an upwardly extending portion attached to the second end of said outwardly extending portion.

7. The device of claim 6 wherein the center of said arcuate depression is approximately ½ inch from the plane of said second side wall.

8. A ladder system comprising:

at least one set of legs;

a top panel having a perimeter, said perimeter having at least a first edge, a second edge, a third edge and a fourth edge, said top panel having a topside and an underside disposed between the first, second, third and fourth edges; and a first side wall extending in an integral fashion from the underside along the first edge, the first side wall having at least one slot through which accessories of the ladder can be attached, an opposing second side wall extending in an integral fashion from the underside along the second edge, said second side wall having an arcuate depression with an outer surface and a hook extending from said outer surface, a third side wall extending in an integral fashion from the underside along the third edge and in juxtaposition with the first and second side walls, and a fourth side wall opposing said third side wall and extending in an integral fashion from the underside along the fourth edge and in juxtaposition with the first and second side walls, said third and fourth side walls having holes through which at least one set of legs is attached to the ladder top.

9. A ladder top as described in claim 8 wherein said topside and said panel has a grid of ridges integrally formed on said topside of said top panel and extending outwardly therefrom.

10. A ladder top as described in claim 9 wherein the top panel includes a plurality of holes arranged in a spaced relationship.

11. A ladder top as described in claim 10 wherein the topside of the top panel includes a recess having a circular shaped periphery and a flat base.

12. A ladder top as described in claim 11 wherein the recess is disposed essentially in the center of the topside of the top panel.

* * * * *